US008528622B2

(12) United States Patent
Ehrlich

(10) Patent No.: US 8,528,622 B2
(45) Date of Patent: Sep. 10, 2013

(54) OVERHEAD DOOR ASSEMBLY FOR A STORAGE CONTAINER

(75) Inventor: Rodney P. Ehrlich, Monticello, IN (US)

(73) Assignee: Wabash National, L.P., Lafayette, IN (US)

( * ) Notice: Subject to any disclaimer, the term of this patent is extended or adjusted under 35 U.S.C. 154(b) by 81 days.

(21) Appl. No.: 13/113,144

(22) Filed: May 23, 2011

(65) Prior Publication Data

US 2011/0290431 A1 Dec. 1, 2011

Related U.S. Application Data

(60) Provisional application No. 61/348,392, filed on May 26, 2010.

(51) Int. Cl.
*E05D 15/16* (2006.01)

(52) U.S. Cl.
USPC ..... 160/209; 160/191

(58) Field of Classification Search
USPC ..... 160/201, 209, 191, 192, 193, 189
See application file for complete search history.

(56) References Cited

U.S. PATENT DOCUMENTS 1,990,870 A * 2/1935 Kelly ..... 160/194
2,015,402 A 9/1935 Johanson
2,092,531 A * 9/1937 Dimick ..... 16/84
2,264,642 A * 12/1941 Rowe ..... 160/209
2,323,807 A * 7/1943 Ferris et al. ..... 160/191
2,334,749 A * 11/1943 Burr ..... 160/192
2,391,845 A 12/1945 Rowe
2,436,006 A * 2/1948 Kaiser ..... 160/191
2,525,309 A * 10/1950 Norberg ..... 16/97
2,607,410 A * 8/1952 McKee ..... 160/191
2,643,714 A * 6/1953 Wolf ..... 160/191
2,656,561 A * 10/1953 McKee ..... 16/104
2,684,846 A * 7/1954 Beall ..... 160/193
2,703,236 A 3/1955 Means Verdier
2,786,523 A * 3/1957 Phillips ..... 160/191
2,978,021 A 4/1961 Stroup et al.
3,021,896 A * 2/1962 Buono et al. ..... 160/113
3,056,451 A 10/1962 Federline et al.
3,104,910 A * 9/1963 Kappen ..... 296/51
3,110,512 A 11/1963 Scalf et al.
3,311,159 A 3/1967 Stansberry
3,347,305 A 10/1967 Urbanick
3,436,862 A 4/1969 Stansberry
3,447,192 A * 6/1969 Pemberton ..... 16/104
3,499,478 A * 3/1970 Schneider ..... 160/207
3,894,571 A * 7/1975 Hinchliff ..... 160/201
3,934,635 A 1/1976 Kin
4,119,133 A * 10/1978 Wolf ..... 160/209
4,186,523 A 2/1980 Palmaer
4,492,067 A 1/1985 Martin
4,532,973 A 8/1985 DeFalco
4,537,237 A 8/1985 Sepulveda
4,583,796 A 4/1986 Nakajima (Continued)

*Primary Examiner* — David Purol

(57) ABSTRACT

An overhead door assembly configured to be coupled to a rear end of a storage container, such as a truck trailer, includes a guide track system and a door assembly. The guide track system is coupled to one of the sidewalls of the storage container and includes a first guide track and a second guide track. The door assembly includes a door and plurality of rollers coupled to the door and extending outwardly from a lateral edge of the door. Each of the plurality of rollers is configured to be received within one of the first and second guide tracks.

25 Claims, 7 Drawing Sheets

(56) References Cited

U.S. PATENT DOCUMENTS

| | | | | |
|---|---|---|---|---|
| 4,685,266 | A | | 8/1987 | Mullet |
| 4,732,203 | A | | 3/1988 | Alten |
| 4,779,325 | A | | 10/1988 | Mullet |
| 4,854,365 | A | | 8/1989 | Juneau |
| 4,860,813 | A | | 8/1989 | Ballyns |
| 4,878,529 | A | | 11/1989 | Hormann |
| 4,882,806 | A | | 11/1989 | Davis |
| 4,924,932 | A | | 5/1990 | Esnault |
| 4,981,165 | A | | 1/1991 | Miller et al. |
| 5,016,700 | A | | 5/1991 | Wegner et al. |
| 5,036,899 | A | | 8/1991 | Mullet |
| 5,056,847 | A | | 10/1991 | Stillwell |
| 5,384,975 | A | | 1/1995 | Yuran |
| 5,419,010 | A | | 5/1995 | Mullet |
| 5,445,208 | A | | 8/1995 | Shaner et al. |
| 5,495,640 | A | | 3/1996 | Mullet |
| 5,509,457 | A | | 4/1996 | Jella |
| 5,522,446 | A | | 6/1996 | Mullet |
| 5,544,691 | A | | 8/1996 | Wandio |
| 5,562,141 | A | | 10/1996 | Mullet et al. |
| 5,566,740 | A | | 10/1996 | Mullet et al. |
| 5,615,723 | A | | 4/1997 | Carper |
| 5,632,063 | A | | 5/1997 | Carper et al. |
| 5,636,678 | A | | 6/1997 | Carper |
| 5,659,926 | A | | 8/1997 | Dietrich |
| 5,737,802 | A | * | 4/1998 | Jella ..... 16/93 R |
| 5,743,046 | A | | 4/1998 | Siegler et al. |
| 5,782,283 | A | | 7/1998 | Kendall |
| 5,799,368 | A | * | 9/1998 | Young ..... 16/92 |
| 5,836,499 | A | | 11/1998 | Mullet et al. |
| 5,865,235 | A | | 2/1999 | Krupke et al. |
| 5,909,762 | A | * | 6/1999 | Denoual et al. ..... 160/201 |
| 5,918,660 | A | | 7/1999 | Crawford, III et al. |
| 5,934,352 | A | | 8/1999 | Morgan |
| 5,954,111 | A | | 9/1999 | Ochoa |
| 5,964,268 | A | | 10/1999 | Carper et al. |
| 6,019,269 | A | | 2/2000 | Mullet et al. |
| 6,041,843 | A | | 3/2000 | Mullet |
| 6,047,761 | A | * | 4/2000 | Jaehnen et al. ..... 160/201 |
| 6,082,429 | A | | 7/2000 | Ochoa |
| 6,094,779 | A | * | 8/2000 | Young ..... 16/92 |
| 6,250,361 | B1 | | 6/2001 | Ochoa |
| 6,263,948 | B1 | | 7/2001 | Whitley |
| 6,554,048 | B1 | | 4/2003 | Jella |
| 6,578,619 | B2 | | 6/2003 | Wright |
| 6,615,897 | B2 | | 9/2003 | Dorma |
| 6,705,150 | B1 | | 3/2004 | Jella |
| 6,712,117 | B2 | | 3/2004 | Jella |
| 6,719,032 | B1 | | 4/2004 | Miers |
| 6,725,898 | B2 | | 4/2004 | Mullet et al. |
| 6,742,564 | B2 | * | 6/2004 | Martin ..... 160/201 |
| 6,772,814 | B2 | | 8/2004 | Leist |
| 6,935,400 | B1 | | 8/2005 | Welsh |
| 7,014,386 | B1 | | 3/2006 | Mullet et al. |
| 7,059,379 | B2 | * | 6/2006 | Lewis et al. ..... 160/191 |
| 7,059,380 | B2 | | 6/2006 | Bennett, III et al. |
| 7,128,123 | B2 | | 10/2006 | Mullet et al. |
| 7,201,207 | B2 | | 4/2007 | Colston et al. |
| 7,234,502 | B2 | | 6/2007 | O'Malley |
| RE40,001 | E | | 1/2008 | Siegler et al. |
| 7,383,872 | B1 | | 6/2008 | Jella |
| 7,431,068 | B1 | | 10/2008 | Jella |

* cited by examiner

OVERHEAD DOOR ASSEMBLY FOR A STORAGE CONTAINER

This application claims priority under 35 U.S.C. §119(e) to U.S. Provisional Patent Application Ser. No. 61/348,392 entitled OVERHEAD DOOR ASSEMBLY FOR A STORAGE CONTAINER and filed May 26, 2010, the entirety of which is hereby incorporated by reference herein.

FIELD OF THE INVENTION

The present invention relates generally to a movable overhead door assembly for a storage container, such as a truck trailer or garage, for example.

BACKGROUND

Many storage containers, such as large truck trailers and garages, for example, include an overhead door constructed from longitudinal panels hingedly joined together and supported by rollers that ride in a pair of door guide tracks. The weight of the door may be balanced by a counterbalance mechanism including either a torsion spring system or a pair of extension springs, for example. The counterbalance mechanism is typically mounted on the header wall above the door of the trailer. The guide tracks are typically positioned on the outer sidewalls of the trailer and extend vertically upward from the floor of the opening to the top of the opening, where they then extend backward in a horizontal direction slightly below the roof of the enclosure. During operation, the rollers of the overhead door travel within the guide track and allow the door to be moved between a closed, vertical position to an opened, horizontal position.

SUMMARY

The present invention may comprise one or more of the features recited in the attached claims, and/or one or more of the following features and combinations thereof.

According to one aspect of the present disclosure, an overhead door assembly is configured to be coupled to a storage container, such as a truck trailer. The overhead door assembly includes a guide track system configured to be coupled to one of the sidewalls of the storage container. The guide track system includes a first guide track and a second guide track. The overhead door assembly further includes a door assembly including a door and plurality of rollers coupled to the door and extending outwardly from a lateral edge of the door. Each of the plurality of rollers is received within one of the first and second guide tracks. Further, the plurality of rollers includes an end roller positioned adjacent an upper edge of the door. A shaft of the end roller is positioned above the upper edge of the door when viewed from the side when the door is in a closed, generally vertical position. The end roller rotates about an axis aligned with the longitudinal axis of the lateral edge of the door while each of the plurality of offset rollers rotate about an offset axis spaced-apart from the longitudinal axis of the lateral edge of the door.

In one illustrative embodiment, the plurality of rollers may also include a plurality of offset rollers which may each rotate about an offset axis spaced-apart from the longitudinal axis of the lateral edge of the door. Further, the end roller may rotate about an axis aligned with a longitudinal axis of the lateral edge of the door.

In another illustrative embodiment, a generally vertical plane defined by the outer surface of the door may be aligned with or positioned forward of a rearmost portion of the end roller when the door is in the closed, generally vertical position. Further illustratively, an axis of rotation of the end roller may be laterally spaced-apart from the longitudinal axis of the door.

In still another illustrative embodiment, the first guide track may be positioned generally above the second guide track such that the first guide track is configured to be adjacent to and engaged with one or more roof bows of the storage container.

In one illustrative embodiment, the first guide track may include a first horizontal section and a first curved section. Similarly, the second guide track may include a second horizontal section parallel to the first horizontal section, and a second curved section. Further illustratively, the first curved section may define a radius of curvature different from that of the second curved section. In particular, the radius of curvature of the first curved section may be smaller than the radius of curvature of the second curved section. The first guide track may be positioned generally above the second guide track.

In another illustrative embodiment, the end roller may be positioned within the first guide track and the plurality of offset rollers may be positioned within the second guide track.

In yet another illustrative embodiment, the overhead door assembly may further include a counterbalance mechanism configured to be positioned at a location spaced-apart from a rear end of the storage container. The door of the door assembly is configured to be moved between a vertical, closed position and a horizontal, opened position. Further, the counterbalance mechanism may be positioned forward of the door when the door is in the horizontal, opened position. The overhead door assembly may also include a cable system having a first pulley coupled to a vertical section of the first track and a second pulley coupled a horizontal section of the first track. The cable system may also include a cable having one end coupled to the counterbalance mechanism and another end coupled to one of the plurality of rollers. The overhead door assembly may also include a housing configured to extend downwardly from an inner surface of the roof of the storage container. The counterbalance mechanism may be contained within the housing. Illustratively, a height of the housing may be configured to be approximately the same as a height of a header of the storage container. Accordingly, the door may be configured to be positioned between the header and the housing when the door is in the horizontal, opened position.

According to another aspect of the present disclosure, an overhead door assembly configured to be coupled to a storage container, such as a truck trailer includes a guide track system configured to be coupled to the sidewall of the storage container and a door assembly including a door and a plurality of rollers coupled to the door and positioned within the guide track system. The overhead door assembly further includes a counterbalance mechanism coupled to the guide track system and the door assembly. Illustratively, the counterbalance mechanism is configured to be spaced-apart from a rear end of the storage container.

In one illustrative embodiment of this disclosure, the door is configured to move between a vertical, closed position and a horizontal, opened position. Illustratively, the counterbalance mechanism may be positioned forward of the door when the door is in both the closed and opened positions.

In another illustrative embodiment of this disclosure, the overhead door assembly may also include a cable system having a cable with a first end coupled to the counterbalance mechanism and a second end coupled to a shaft of one of the plurality of rollers. Further illustratively, the second end of the cable may be coupled to an upper half of the door.

In still another illustrative embodiment of this disclosure, the guide track system may include an upper track configured to be coupled to a sidewall of the storage container and a lower track configured to be coupled to the same sidewall of the storage container. Illustratively, the plurality of rollers may include an end roller adjacent an upper edge of the door and an offset roller adjacent a lateral edge of the door. Further illustratively, the end roller may be received within the outer track and the offset roller may be received within the inner track. Accordingly, the axis of rotation of the end roller may be aligned with the longitudinal axis of the lateral edge of the door and the axis of rotation of the offset roller may be spaced-apart from the longitudinal axis of the lateral edge of the door. Further, a generally vertical plane defined by the outer surface of the door may be aligned with or positioned forward of a rearmost portion of the end roller when the door s in the closed, generally vertical position.

According to still another aspect of the present disclosure, an overhead door assembly configured to be coupled to the rear end of a storage container, such as a truck trailer, includes a guide track system configured to be coupled to the sidewall of the storage container. The guide track system includes a vertical section, a curved section, and a horizontal section. A door assembly includes a door and a plurality of rollers coupled to the door and positioned within the guide track system. The door is movable between a vertical, closed position and a horizontal, opened position. The overhead door assembly further includes a counterbalance mechanism coupled to the guide track system and the door assembly, and a cable system. Illustratively, the cable system includes a cable having a first end coupled to the counterbalance mechanism and a second end coupled to one of the plurality of rollers of the door assembly.

In one illustrative embodiment, the cable system may include a first pulley coupled to the vertical section adjacent the curved section of the guide track and a second pulley coupled to the horizontal section adjacent the curved section of the guide track. Further illustratively, the cable may be engaged with the first and second pulleys when the door is in the closed position and the cable may be disengaged from the first and second pulleys when the door is in the opened position.

In another illustrative embodiment of this disclosure, an axis of rotation of each of the plurality of rollers is offset from a longitudinal axis of the door. Further illustratively, the cable may be coupled to the upper-most roller of the plurality of rollers.

In still another illustrative embodiment, the counterbalance mechanism may be located forward of the door when the door is in the horizontal, opened position. Further illustratively, the counterbalance mechanism may be positioned between the door and a front end of the storage container when the door is in both the vertical, closed position and the horizontal, opened position.

In yet another illustrative embodiment of this disclosure, a bottom end of the door may be positioned adjacent a horizontal section of the guide track system when the door is in the horizontal, opened position.

In another illustrative embodiment, the overhead door assembly may further include a pull strap assembly. The pull-strap assembly may include a pull-strap configured to be coupled at a first end to an inner surface of the sidewall of the storage container and coupled at a second end to a bottom-most roller of the plurality of rollers. Illustratively, the pull strap may include an elastic portion and a non-elastic portion. Further illustratively, the pull-strap may be engaged with first and second pulleys of the cable system when the door is in the horizontal, opened position and may be disengaged from the first and second pulleys when the door is in the vertical, closed position.

In still another illustrative embodiment, a pulling force of the cable may be redirected from that of a vertical force to a horizontal force as the one of the plurality of rollers of the door assembly to which the cable is coupled is moved through the curved section of the guide track when the door assembly is moved to the opened position.

DESCRIPTION OF THE ILLUSTRATIVE EMBODIMENTS

For the purposes of promoting an understanding of the principles of the invention, reference will now be made to illustrative embodiments shown in the attached drawings and specific language will be used to describe the same. While the concepts of this disclosure are described in relation to a truck trailer, it will be understood that they are equally applicable to other mobile or stationary storage containers, as well as refrigerated and un-refrigerated trailers or storage containers, which include an overheard door assembly.

Figure 1:
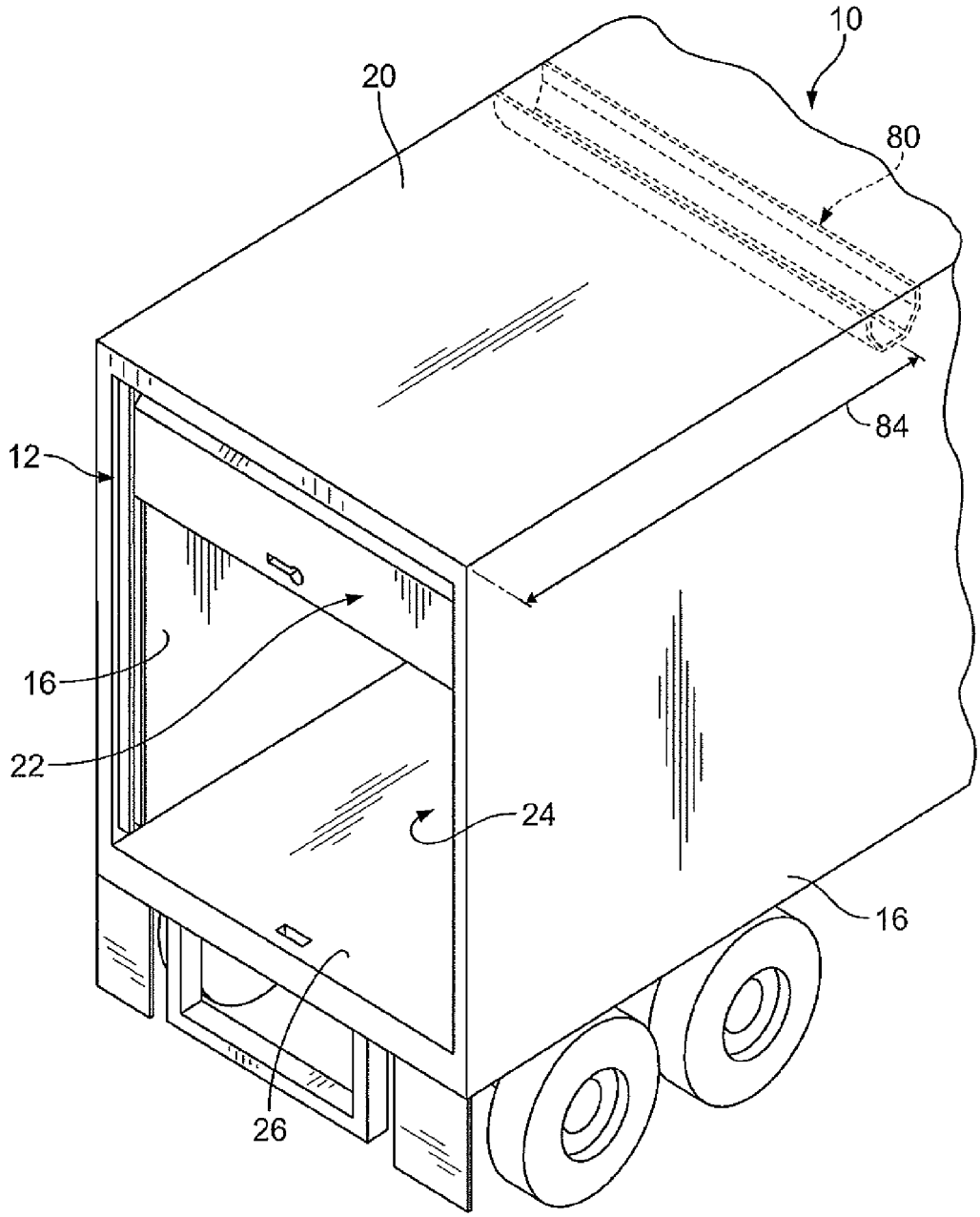
FIG. 1 is a rear, perspective view of a portion of a truck trailer including an overhead door assembly and showing a door of the assembly in a partially-opened position.

As shown in FIG. 1, a truck trailer 10 includes an overhead door assembly 12 at the rear of the trailer 10. Illustratively, as is discussed in greater detail below, the overhead door assembly 12 includes first and second guide track systems 14 each coupled to one of the two sidewalls 16 of the trailer 10, a rotational counterbalance mechanism 18 coupled to the roof 20 of the trailer 10, and an overhead door 22 coupled to both the guide track systems 14 and the counterbalance mechanism 18. The overhead door 22 operates to close a rear door opening 24 of the trailer 10 defined by the sidewalls 16 of the trailer 10, a floor 26 of the trailer 10, and the roof 20 of the trailer 10.

Figure 2A:
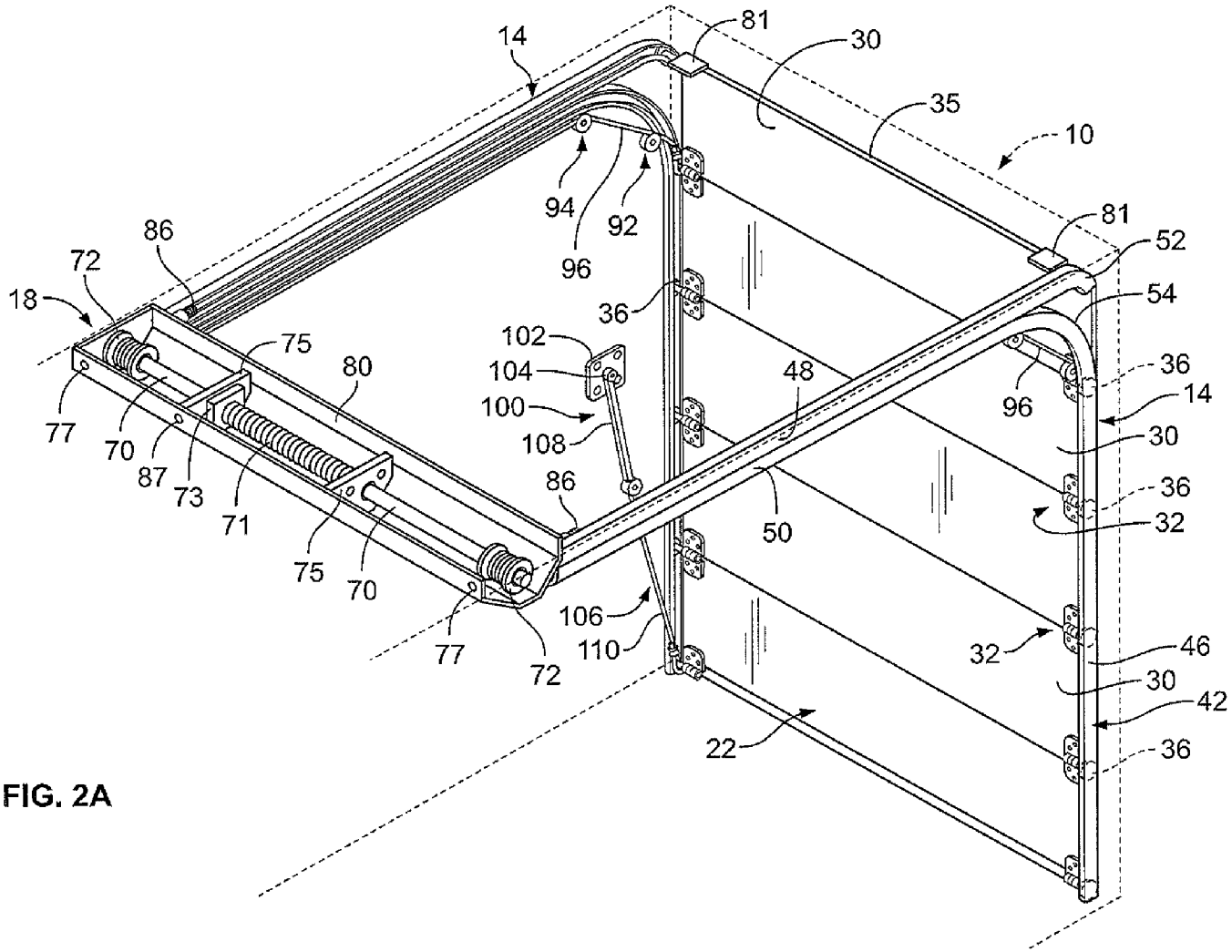
FIG. 2A is a perspective view of the overhead door assembly of FIG. 1 showing a door in a closed, vertical position.
Figures 2B, 6:
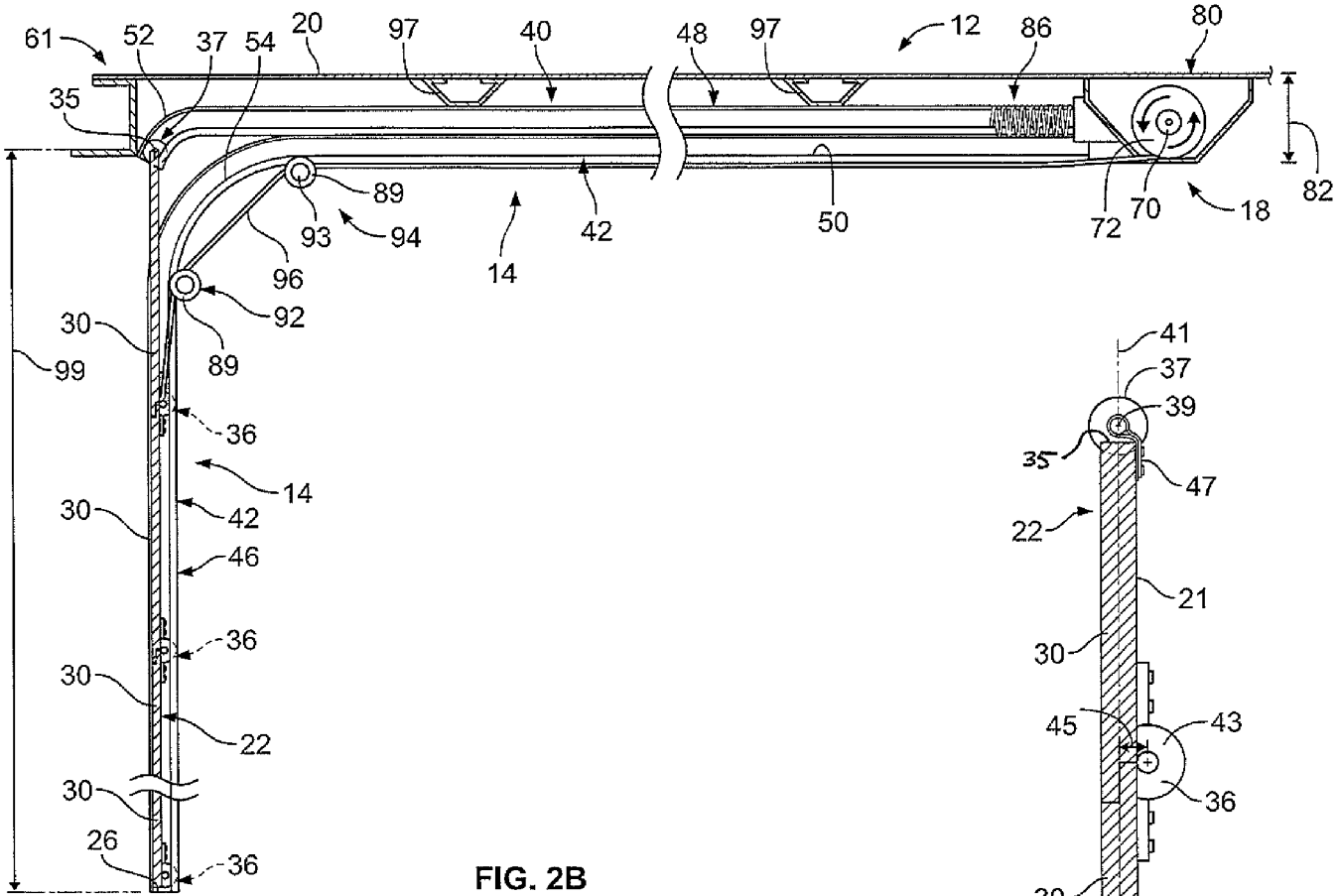
FIG. 2B is a side, sectional view of a guide track system of the overhead door assembly again showing the door in the closed, vertical position.
FIG. 6 is an enlarged view of a portion of FIG. 2B showing an end roller of the overhead door assembly.
Figure 3A:
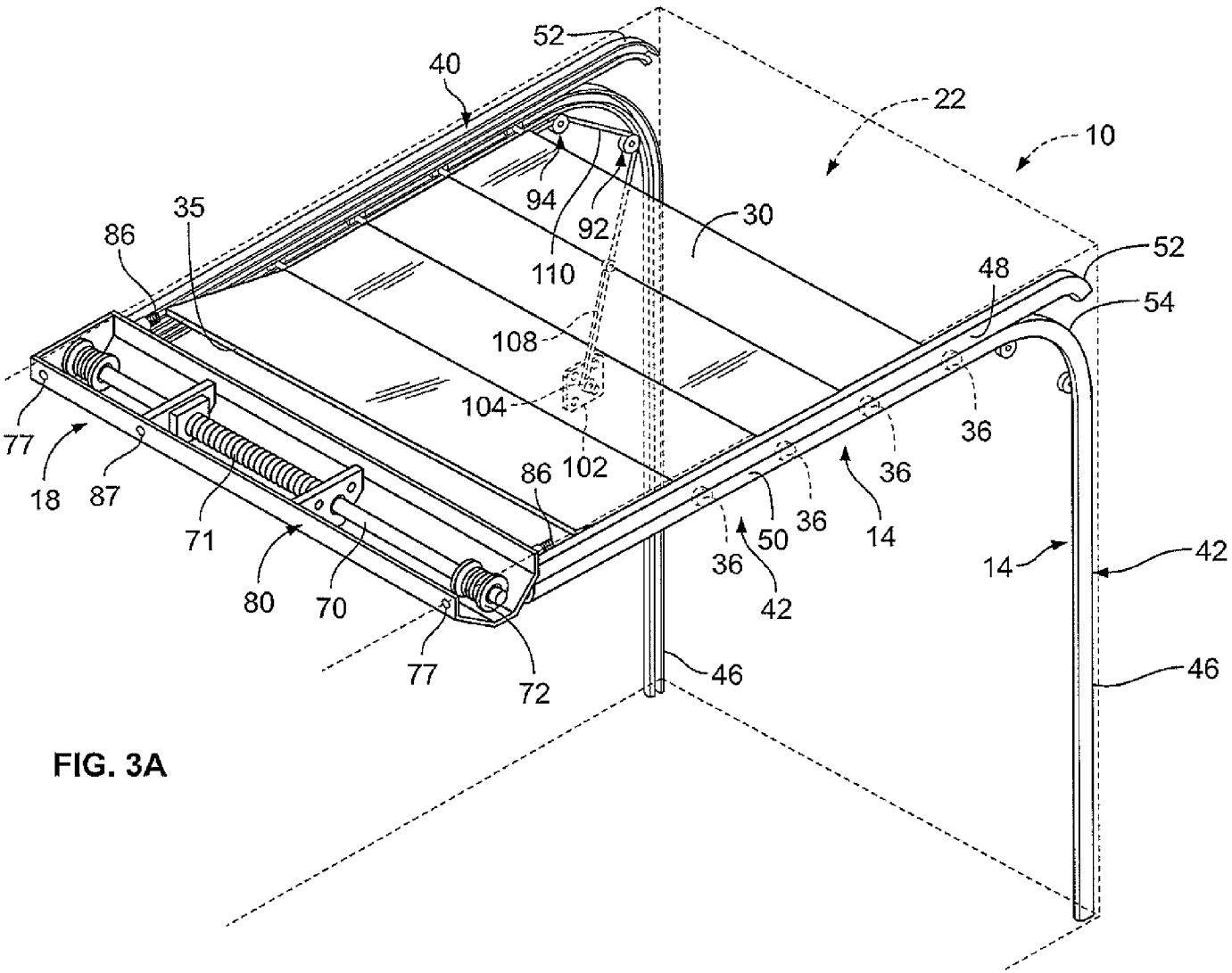
FIG. 3A is a perspective view similar to FIG. 2A showing the door in an opened, horizontal position.
Figure 3B:
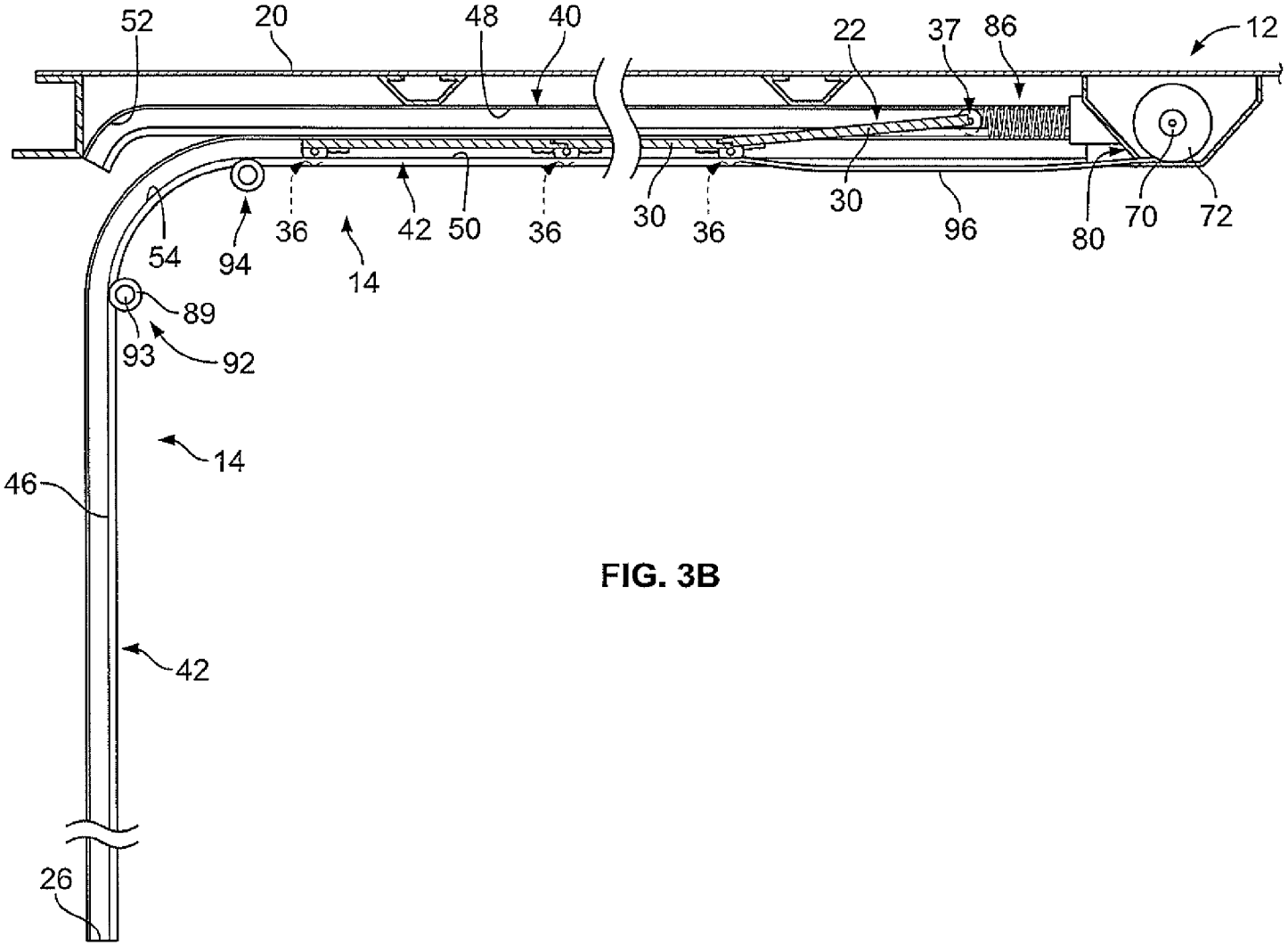
FIG. 3B is a side, sectional view similar to FIG. 2B again showing the door in the opened, horizontal position.
Figure 5:
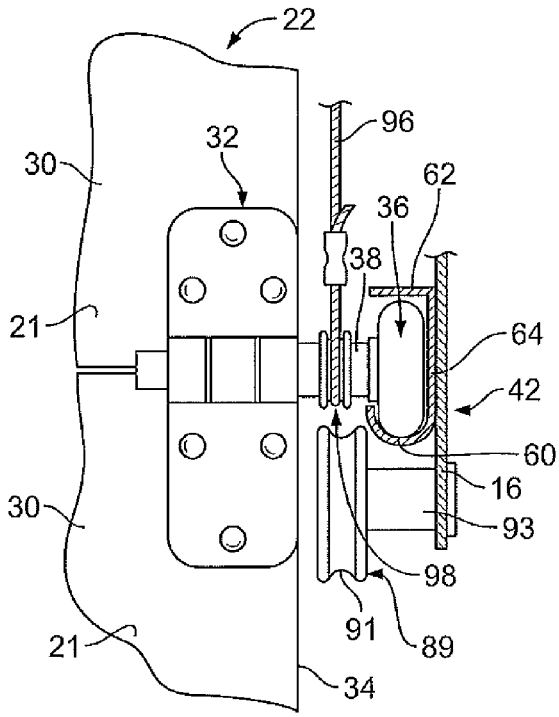
FIG. 5 is a plan view of the portion of the overhead door assembly shown in FIG. 4.

Illustratively, the overhead door 22 is movable relative to the guide track systems 14 between a vertical, closed position (shown in FIGS. 2A and 2B) and a horizontal, opened position (shown in FIGS. 3A and 3B). The overhead door 22 includes a plurality of lateral panels 30 coupled together by hinges 32 (shown in FIGS. 2A and 5) to allow the door 22 to move along the track systems 14 between the opened and closed positions. In other words, the lateral panels 30 are disposed one on top of the other with each panel 30 hinged to the panel above 30. Illustratively, each panel 30 of the door 22 includes a pair of lateral edge surfaces 34 (shown in FIG. 5) which extend parallel to the direction of movement of the door 22 between the opened and closed positions. A series of rollers 36 is spaced along the length of each of the lateral edge surfaces 34 of the door 22 and is attached to the door 22 by a series of shafts 38. As shown in FIG. 5, a roller 36 is associated with each hinge 32 such that the door 22 includes a roller 36 located at the junction between each lateral panel 30 of the door 22. Each roller 36 is able to rotate about the respective shaft 38 and is positioned within one of the respective first and second guide track systems 14. Each roller 36 and shaft 38 cooperate to define a roller assembly such that the door 22 includes a plurality of roller assemblies adjacent the opposite, lateral edges 34 thereof. Illustratively, while the rollers 36 are coupled to each hinge 32, it is within the scope of this disclosure to couple the rollers 36 to the door panels 30 at other suitable locations and to provide any suitable numbers of rollers 36 on the door 22 in order to allow the door 22 to move along the guide track systems 14 between the opened and closed positions.

Illustratively, the overhead door assembly 12 includes the right and left guide track systems 14 such that each guide track system 14 is rigidly coupled to one of the two sidewalls 16 of the trailer 10. The first and second guide track systems 14 are provided on either side of the doorway 24 at the rear end of the trailer 10 for receiving the rollers 36 disposed on the adjacent edges 34 of the panels 30. While the overhead door assembly 12 includes two separate guide track systems, i.e., the right and left guide track systems 14, for purposes of simplicity, only the left guide track system 14 is described in detail herein. It should be understood, however, that the right guide track system is generally identical to the left guide track system and includes the same or similar components. Accordingly, although only the left guide track system 14 is described, an identical, right guide track system is positioned along the interior of the opposite sidewall 16, as shown in FIGS. 2A and 3A such that the rollers 36 on each lateral edge 34 of the door 22 are positioned within one of respective guide track systems. In this manner, the rollers 36 travel within a guide track system and enable the overhead door 22 to move from the vertical, closed position to the horizontal, opened position.

As shown in FIGS. 2A-3B, the guide track system 14 includes first and second guide tracks 40, 42. The first guide track 40 is positioned slightly below the roof 20 of the trailer 10 and includes a curved portion 52 adjacent the rear end of the trailer 10 near the door opening 24 and a generally horizontal section 48 extending parallel to the roof 20 in a direction toward a front end of the trailer 10. In particular, the generally horizontal section 48 of the first guide track 40 is positioned adjacent to and generally abutting a bottom portion of the roof bows 97 of the trailer 10. In other words, the first guide track 40 is positioned just below the roof bows 97 in order to optimize the location of the door 22 in the opened, horizontal position such that the door 22 is generally located in an out-of-the-way position providing an increased distance between the floor 26 of the trailer 10 and the door 22 when the door 22 is in the opened, horizontal position, as is discussed in greater detail below The second guide track 42 extends upwardly from the floor 26 of the door opening 24 and along the interior surface of the sidewall 16 of the trailer 10 until the track 42 reaches a position slightly below the roof 20 of the trailer 10. Upon reaching an area near the roof 20, the guide track 42 bends to create a curved portion and then continues in a generally horizontal direction parallel to the roof 20. As such, the second guide track 42 includes a vertical section 46, a horizontal section 50 positioned just below the horizontal section 48 of the first track 40, and a curved section 54 interconnecting the respective vertical and horizontal sections 46, 50. Illustratively, the horizontal section 48 of the first guide track 40 is positioned generally outside, or above, the horizontal section 50 of the second, or inner, guide track 42.

As shown in FIGS. 2A, 2B, 3A and 3B, the horizontal sections 48, 50 of the first and second guide tracks 40, 42 are parallel to each other. However, the radius of curvature of the curved section 52 of the guide track 40 is different from the radius of curvature of the curved section 54 of the guide track 42. Illustratively, the curved section 52 of the first, or outer, guide track 40 defines a smaller radius of curvature than the curved section 54 of the second, inner guide track 42. However, it is within the scope of this disclosure to provide curved sections 52, 54 having the same or similar radii of curvature. Further illustratively, the curved section 52 of the upper track 40 may alternatively include a larger radius of curvature than that shown in FIGS. 2A-3B by curving the upper track 40 up to the roof 20 of the trailer 10 in an open area between the header 61 and the first (or rear-most) roof bow 97 of the roof 20. Illustratively, while a larger radius of curvature generally operates to provide a smoother movement of the door 22 between the vertical and horizontal positions, it is within the scope of this disclosure to provide any suitable radius of curvature for each of the curved sections 52, 54 to allow movement of the door between the vertical and horizontal positions.

As shown in FIG. 5, the guide track 42 has a generally "c-shaped" cross-section including a curved, inner wall 60, a generally straight outer wall 62, and a back wall 64. This generally c-shaped structure of the track 42 operates to maintain the rollers 36 therein during movement of the door 22 between the closed position and the opened position. Illustratively, the back wall 64 of the guide track 42 is in contact with or in close proximity to the sidewall 16 of the trailer 10. Although not shown, the overhead door assembly 12 includes mounting brackets to mount the guide tracks 40, 42 to the sidewalls 16 of the trailer 10. Further, though not shown, the cross-sectional shape of the guide track 40 is generally the same as or similar to the cross-sectional shape of the guide track 42 to maintain any rollers of the door 22 therein during operation of the door assembly 12. While the particular shape and structure of the guide tracks 40, 42 is shown and described herein, it is within the scope of this disclosure for the guide tracks 40, 42 to define other cross-sectional shapes suitable for guiding rollers of the door 22 during movement of the door 22 between the opened and closed positions.

Illustratively, the rollers 36 of the door 22 are offset rollers 36 in that the shaft 38 associated with each roller 36 is positioned adjacent and coupled to the inside surface 21 of the door 22. As such, the axis of rotation 43 of these offset rollers 36 (i.e., along the longitudinal axis of the respective shaft 38) is laterally offset, or spaced-apart, a distance 45 from a longitudinal, or centerline, plane 41 extending through the door 22. The door 22 further includes an end roller 37 (shown in FIGS. 2B and 3B) adjacent an upper edge 35 of the door 22. Illustratively, the upper edge 35 of the door 22 is the upper end of the door 22 when the door 22 is in the vertical, closed position, shown in FIGS. 2A and 2B. Illustratively, the end roller 37 is mounted via a bracket 47 on the centerline of the door 22 such that the shaft 38 of the end roller 37 defines an axis of rotation 39 that is generally aligned with (i.e., intersects) the longitudinal, centerline plane 41 through the door 22, as shown in FIG. 6. To contrast, as noted above, the axis of rotation 43 of each of the remaining rollers 36 is offset from, and does not intersect, the longitudinal plane 41 of the door 22. Further, the axis of rotation 39 of the end roller 37 is positioned above the upper edge 35 of the door 22 when viewed from the side or cross-sectionally as shown in FIG. 6. To contrast, the axis of rotation 43 of the offset rollers 36 is adjacent the inside surface 21 of the door 22. Accordingly, the axis of rotation 39 of the end roller 37 is spaced laterally apart from the axis of rotation of the offset rollers 36 such that the end roller 37 is positioned within the first, or outer, track 40 of the guide track system 14 whereas the offset rollers 36 are each positioned within the second, or inner, track 42 of the system 14, as shown in FIGS. 2B and 3B. As is discussed in greater detail below, the end roller 37 remains within the first track 40 during movement of the overhead door 22 between the vertical, closed position and the horizontal, opened position, whereas the offset rollers 36 each remain within the second track 42 during this movement.

Illustratively, a diameter of the end roller 37 is smaller than a diameter of the offset rollers 36. Accordingly, a width of the first track 40 is smaller than a width of the second track 42. Illustratively, for example, the second track 42 may have approximately a 2 inch width while the first, or upper, track 40 may have a 1¼ inch width. It is also within the scope of this disclosure, however, for the diameter of the end roller 37 to be the same size as or larger than the diameter of the offset rollers 36. As such, the rollers 36, 37 and the corresponding tracks 42, 40 may be any suitable size. Further illustratively, while the end roller 37 is mounted on the centerline, or longitudinal axis 41, of the door, it is within the scope of this disclosure to mount the end roller 37 in an offset manner similar to that of the offset rollers 36.

Figure 7:
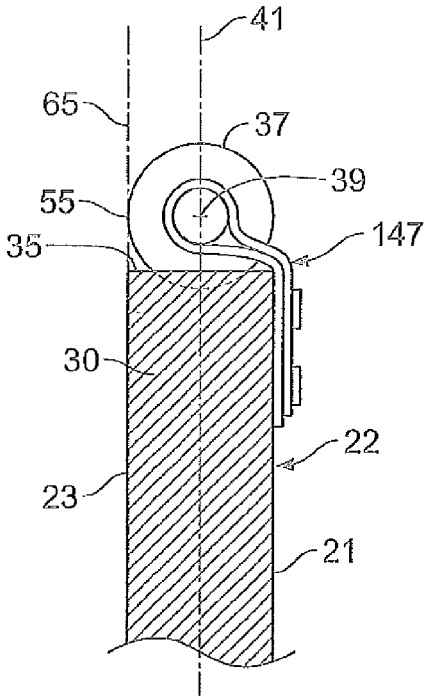
FIG. 7 is an enlarged, side sectional view of a portion of the door, similar to FIG. 6, showing an alternative end roller assembly.
Figure 8:
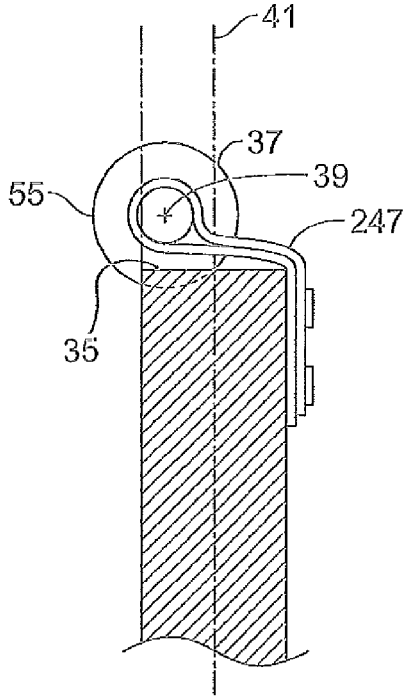
FIG. 8 is an enlarged, side sectional view of a portion of the door, similar to FIGS. 6 and 7, showing another end roller assembly.
Figure 9:
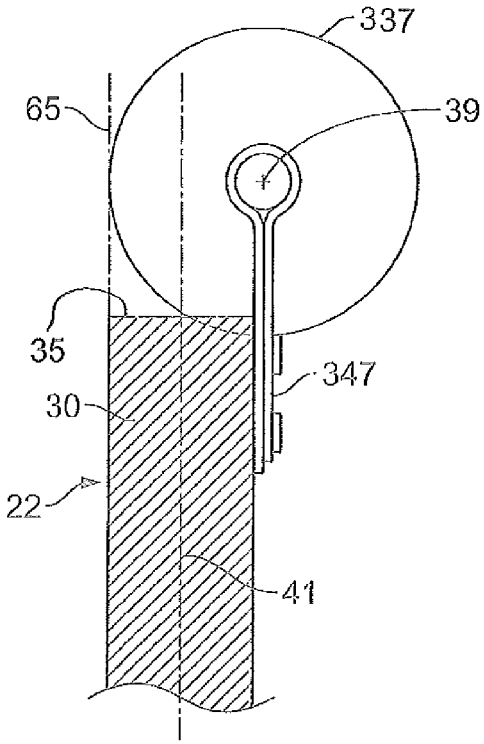
FIG. 9 is an enlarged, side sectional view of a portion of the door, similar to FIGS. 6-8, showing yet another end roller assembly.

In particular, as shown in FIGS. 7-9, the location of the end roller 37 may be moved laterally to position the end roller 37 in a number of suitable locations on the door 22. For example, as shown in FIG. 7, the end roller 37 of the door 22 is coupled to the door using a mounting bracket 147 similar to the mounting bracket 47 shown in FIG. 6. The mounting bracket 147 is bolted to the inside surface 21 of the door and positioned such that the shaft 38 of the roller 37 is located above the upper edge 35 of the door 22. Further illustratively, a rearmost point or portion 55 of the end roller 37 is generally aligned with a plane 65 parallel to an outer surface 23 of the door 22. In other words, the rearmost portion 55 of the end roller 37 is tangent to the plane 65 formed by the outer surface 23 of the door 22. In particular, while the axis of rotation 39 of the roller 37 intersects the centerline plane 41 of the door, other arrangements may be provided wherein the axis of rotation 39 of the end roller 37 is offset from the centerline plane 41 of the door 22.

For example, looking to FIG. 8, an alternative bracket 247 and end roller 37 arrangement is provided wherein the rearmost portion 55 of the end roller 37 is positioned rearward of the plane 65 defined by the outer surface 23 of the door 22. Further, the axis of rotation 39 of the end roller 37 shown in FIG. 8 is laterally offset from the centerline plane 41 of the door 22. In particular, the axis of rotation 39 of the end roller 37 shown in FIG. 8 is offset rearwardly from the centerline plane 41 of the door 22. Alternatively, as shown in FIG. 9, an alternative bracket 347 and alternative, larger end roller 337 arrangement is provided wherein the rearmost portion 55 of the end roller 37 is tangent to, or aligned with the plane 65 defined by the outer surface 23 of the door 22. Further, the axis of rotation 39 of the end roller 37 shown in FIG. 9 is laterally offset from the centerline plane 41 of the door 22. In particular, the axis of rotation 39 of the end roller 37 shown in FIG. 9 is offset forwardly from the centerline plane 41 of the door 22.

Illustratively, while the various illustrative embodiments are shown in FIGS. 6-9, it is within the scope of this disclosure to position the end roller 37 in any suitable location whereby an outer surface 23 of the door 22 is aligned with or forward of the rearmost point or portion 55 of the end roller 37 when the door assembly is viewed from the side, as shown in FIGS. 6-9, for example. In other words, the outer surface 23 of the door 22 does not extend rearward, or to the left as viewed in FIGS. 6-9, of the rearmost point or portion 55 of the end roller 37. It should be noted that the shaft 38 of the end roller 37, and thus the axis of rotation 39 of the end roller 37, remains positioned above the upper edge 35 of the door 22, as viewed from the side in FIGS. 6-9, for example, when the door 22 is in the closed position. It should further be understood that the size of the end roller 37 may be smaller or larger than that which is illustratively shown in the figures.

Looking still to FIGS. 2A-3B, the overhead door assembly 12 further includes the counterbalance mechanism 18. As is generally understood by one skilled in the art, overhead doors generally require a counterbalancing force which allows the door to be more easily moved between the opened and closed positions. Such counterbalancing force for the overhead door assembly 12 of the present disclosure is provided by the illustrative counterbalance mechanism 18.

Illustratively, the counterbalance mechanism 18 is a torsion spring counterbalance mechanism and includes a lateral torsion bar 70, a cable drum 72 positioned at each end of the bar 70, and one or more torsion springs 71 wound around the bar 70. Illustratively, the torsion springs may be helical torsion springs or other suitable springs or tensioning devices known to those skilled in the art. Further, while the particular counterbalance mechanism 18 disclosed herein is a torsion spring counterbalance mechanism, it is within the scope of this disclosure to alternatively provide a counterbalance mechanism using extension springs as well.

As is generally understood by one skilled in the art, the torsion spring 71 includes a first end operatively connected to the torsion shaft 70 and another end operatively connected to a winding mechanism 73 of the counterbalance mechanism 18. During operation, the torsion shaft 70 rotates to allow the raising and lowering of the door. The winding mechanism 73 may be supported by a fixed support 75 at each end of the torsion shaft 70. The torsion shaft 70 is supported for rotation between the fixed supports and the drums 72, which are rigidly affixed to the torsion shaft 70, and is urged to rotate therewith. The torsion springs 71 of the counterbalance mechanism 18 are typically wound during the installation of the overhead door assembly 12 such that they are provided with the necessary preset torque. The gear winding mechanism 73 is provided for setting the appropriate torque or number of winds in the spring 71. A counter may also be provided to indicate to the installer the number of winds being given to the spring. One illustrative counterbalance mechanism, including an illustrative winding mechanism, is disclosed in U.S. Pat. Nos. 5,632,063 and 4,882,806, the disclosures of which are hereby incorporated by reference herein.

As further shown, the counterbalance mechanism 18 is contained within a counterbalancing housing 80. Illustratively, the counterbalance housing 80 may include an aperture 87 therethrough to allow an operator to wind the winding mechanism 73 or another such mechanism as that disclosed in the '063 patent, for example. Alternatively, the sidewall 16 of the trailer 10 may include an aperture (not shown) to provide an operator access to the end of an alternative counterbalance mechanism (not shown). This alternative counterbalance mechanism may include a ratchet and winding mechanism positioned at one end of the counterbalance mechanism in order to allow the operator to wind the counterbalance mechanism from outside the trailer 10 via the access aperture through the trailer sidewall 16. Illustratively, the counterbalance housing 80 further includes a pair of second apertures 77 through a front sidewall of the counterbalance housing to provide an operator access to each drum 72.

Looking now to FIGS. 2A and 3A, the torsion spring, shaft 70, and drums 72 of the counterbalance mechanism 18 are all located within the housing 80. The housing is coupled to and extends downwardly from an inside surface of the roof 20 of the trailer 10. Illustratively, the housing 80 has a height 82 of approximately three inches and extends laterally across the width of the trailer 10, as shown in FIGS. 2A and 3A and in phantom in FIG. 1. As shown in FIGS. 1, and 2A-3A, the housing 80, and thus the counterbalance mechanism 18 contained therein, is spaced-apart a distance 84 from the rear end of the trailer 10. Illustratively, the distance 84 is approximately 10 feet such that the housing 80 and counterbalance mechanism 18 are positioned approximately ten feet forward of the rear end of the trailer 10. As such, and as is discussed in greater detail below, the counterbalance mechanism 18 is located forward of the door 22 when the door 22 is in the horizontal, opened position, as shown in FIGS. 3A and 3B such that the counterbalance mechanism 18 is always positioned between the door 22 and a front end (not shown) of the trailer 22 regardless of whether the door 22 is in the closed or opened positions.

While the counterbalance mechanism 18 is spaced approximately 10 feet forward of the rear end of the trailer 10, it is within the scope of this disclosure to position the counterbalance mechanism 18 at any suitable location spaced-apart from the rear end of the trailer 10. Illustratively, the housing 80 for the counterbalance mechanism 18 may include one or more windows, cut-outs, apertures or removable panels to allow an operator access to the components of the counterbalance mechanism 18 contained therein. As is discussed in greater detail below, the housing 80 for the counterbalance mechanism 18 operates both to protect the components of the counterbalance mechanism 18 contained therein, as well as to protect, or shield, the upper edge 35 of the door 22 (when in the opened, horizontal position) from being unintentionally impacted and moved by freight during an unloading process, for example.

Looking now to FIGS. 2A-5, the overhead door assembly 12 further includes a pair of cable systems 90 coupled to both the counterbalance mechanism 18 and the door 22 and associated with each of the right and left guide track assemblies 14. While the overhead door assembly 12 includes both right and left cable systems 90, only the left cable system associated with the left guide track system 14 is shown and described herein. It should be understood, however, that the right cable system is generally identical to the left cable system and includes the same or similar components.

Illustratively, the cable system 90 includes a first cable pulley 92 coupled to the sidewall 16 of the trailer 10 adjacent the vertical section 46 of the inner guide track 42 and a second cable pulley 94 coupled to the sidewall 16 of the trailer 10 adjacent the horizontal section 50 of the inner guide track 42. Illustratively, as shown in FIGS. 2A-3B, each of the first and second cable pulleys 92, 94 is also positioned adjacent the curved section 54 of the inner guide track 42. In particular, the pulleys 92, 94 are placed at or near the radius tangent points of the curved section 54. As shown in FIGS. 2B, 3B, and 5, each pulley 92 includes a wheel 89 defining a cable-receiving groove 91 therein, and an axle, or shaft, 93 about which the wheel 89 freely rotates. The shaft 93 of each pulley 92, 94 is coupled to the sidewall 16 of the trailer.

Figure 4:
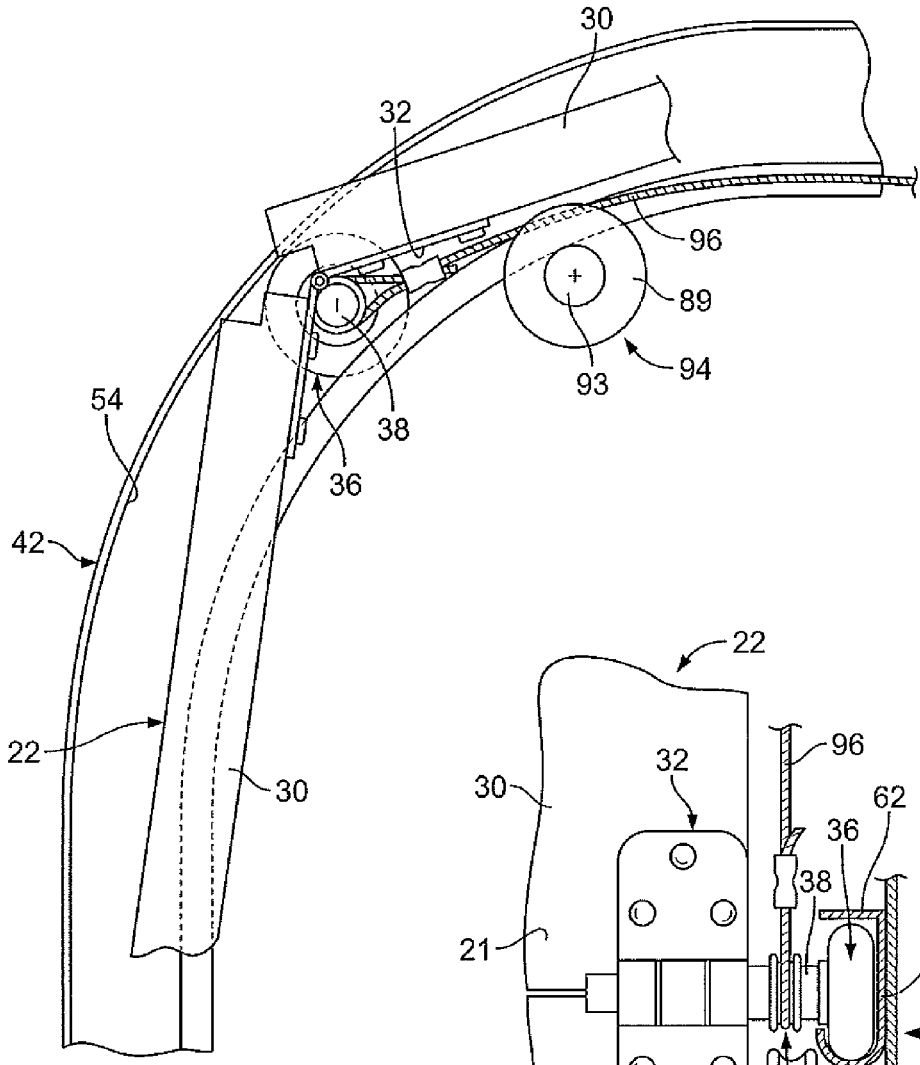
FIG. 4 is side view of a portion of the overhead door assembly showing a cable of the overhead door assembly coupled to a roller of the door.

The cable system 90 further includes a steel counterbalance cable 96 having a first end (not shown) coupled to the counterbalance mechanism 18 and a second end 98 coupled to one of the offset rollers 36 associated with each lateral edge 34 of the door assembly 12. In particular, the first end of the cable 96 is coupled to the respective cable drum 72 of the counterbalance mechanism 18 and is configured to be wound around the drum 72 as the door 22 is moved to the opened position. Each cable 96 extends from the respective drum 72 such that, as shown in FIGS. 4 and 5, the second end 98 of the cable 96 is coupled to the shaft 38 of one of the offset rollers 36. In particular, the cable 96 is coupled to the upper-most offset roller 36, as shown in FIGS. 2B and 3B, and is coupled to the door 22 at a location generally within the upper half of the door 22. Further illustratively, the attachment point of the cable 96 to the shaft 38 of the upper-most offset roller 36 is in-line with the cable pulleys 92, 94, as shown in FIGS. 4 and 5. It should be understood, however, that the cable 96 may be coupled to any of the offset rollers 36. As is discussed in greater detail below, the pulleys 92, 94 operate to pick up or "grab" the cable 96 as it passes over each pulley 92, 94 during movement of the door 22 between the opened and closed positions.

The overhead door assembly 12 further includes a rebound spring 86 coupled to the counterbalance mechanism 18 and/or the housing 80 containing the counterbalance mechanism 18. Illustratively, the rebound spring 86 is coupled to each end of the counterbalance housing 80. In particular, the rebound spring 86 is positioned within the horizontal portion 48 of each outer track 40 adjacent the counterbalance mechanism housing 80. The rebound spring 86 is provided to prevent the upper end of the door 22 from forcefully engaging the counterbalance mechanism 18 when the door 22 is moved to the opened position. While the rebound spring 86 is positioned within the track 40, it should be understood that the rebound spring 86 may be located in any suitable position along the width of the housing 80 such that the spring 86 will be impacted by the door 22 when the door 22 is moved to the opened position. In particular, each rebound spring 86 is impacted by a corresponding bumper plate 81 coupled to the upper edge 35 of the door 22. While two illustrative rebound springs 86 are provided, it is within the scope of this disclosure to include any number of rebound springs between the counterbalance mechanism 18 and the upper edge 35 of the door 22. Further illustratively, it is within the scope of this disclosure to use a pneumatic plunger and/or other suitable dampening or bumper-like device to prevent the upper end of the door 22 from forcefully engaging the counterbalance mechanism 18 and/or housing 80 when the door is moved to the opened position.

In use, the overhead door assembly 12 operates to allow the door 22 to move between the closed, vertical position shown in FIGS. 2A and 2B and the opened, horizontal position shown in FIGS. 3A and 3B. In particular, when the door 22 is in the closed, vertical position, the offset rollers 36 are located within the second, or inner, guide track 42. Specifically, the offset rollers 36 are located within the vertical section 46 of the inner guide track 42, as shown in FIGS. 2A and 2B. The end roller 37, however, is positioned within the first, or outer, guide track 40. Specifically, as shown in FIGS. 2A and 2B, the end roller 37 is positioned within the curved section 52 of the guide track 40 at the open, front end of the guide track 40. The cable 96 associated with each guide track system 14 is engaged with and received within a cable-receiving groove 91 of each of the cable pulleys 92, 94. Illustratively, in the fully-closed position, the uppermost offset roller 36 to which the cable 96 is coupled is positioned vertically below (and offset from) the first cable pulley 92.

When the door 22 is raised and moved toward the opened position, the torsion spring 71 of the counterbalance mechanism 18 unwinds such that stored tension in the spring operates to help lift the door 22 by turning the torsion shaft 70, thus turning the cable drums 72 in the counterclockwise direction shown in FIGS. 2A and 2B in order to wrap the cable 96 around cable-receiving grooves in the cable drum 72. In other words, the counterbalance mechanism 18 is used to help lift the weight of the door 22 while the cable 96 operates to first pull the door 22 vertically and then horizontally along the guide track system 14. Illustratively, when the door 22 is lowered, the cable 96 unwraps from the drum 72 and the torsion spring 71 is rewound about the torsion shaft 70 to full tension.

As the door 22 is raised, the end roller 37 rides along the outer guide track 40 from its location within the curved section 52 into the horizontal section 48 of the outer guide track 40, as shown in FIGS. 3A and 3B. The offset rollers 36, on the other hand, remain within the inner guide track 42 during movement of the door 22 from the closed position to the opened position. As such, the offset rollers 36 each move from their location within the vertical section 46 of the inner guide track 42, through the curved section 54 of the inner guide track 42, and into the horizontal section 50 of the inner guide track 42.

As the door 22 is raised to the fully-opened position shown in FIGS. 3A and 3B, the cable 96 coupled to the shaft 38 of the upper-most offset roller 36 is pulled by the rotation of the cable drum 72 to provide an upward, vertical pulling force on the door 22 to help pull the door 22 upwardly. As the door moves upwardly, the cable 96 operates to allow the cable 96 to pull the door 22 vertically along the track system 14. As the upper-most offset roller 36 (to which the cable 96 is attached) moves along the inner guide track 42 past the first pulley 92, the pulling force of the cable 96 is redirected and the second pulley 94 operates to pull the door 22 horizontally along the track system 14 toward the closed position. The cable 96 becomes disengaged from each of the pulleys 92, 94 once the upper-most roller 36 moves past the pulleys 92, 94 as the door 22 is raised to the fully-opened position.

Once in the fully-opened position, the end roller 37 is located within the horizontal section 48 of the outer guide track 40 and each of the offset rollers 36 is located within the horizontal section 50 of the inner guide track 42 in order to fully locate the entire door 22 in a horizontal position generally parallel to the roof 20 of the trailer 10. In other words, all panels 30 of the door 22 are positioned adjacent the horizontal sections 48, 50 of the guide tracks 40, 42 when the door 22 is in the fully-opened position. Generally, no portion of the door 22 is left to rest along the curved sections 52, 54 of the guide tracks 40, 42 and into the rear door opening 24. Accordingly, in the fully-opened position, the door 22 does not extend into the rear door opening 24 to block or obstruct any portion of the rear door opening 24. The forward position of the counterbalance mechanism 18 from the rear door opening 24 of the trailer 10 allows the door 22 to be pulled fully to this horizontal position. Illustratively, the door opening 24 defines a height 99 of approximately 110 inches. Thus, when the door 22 is in the opened position, access to the entire, unobstructed 110 inches of the rear door opening 24 is possible.

As noted above, the overhead door assembly 12 includes the rebound springs 86. As the door 22 moves to the full-opened position, the counterbalance mechanism 18 operates to pull the door 22 until the upper edge 35 of the door 22, and specifically the bumper plates 81 of the door, engage the rebound springs 86, which are positioned just rearward of the counterbalance housing 80. By absorbing the impact of the door 22, therefore, the rebound springs 86 prevent the door 22 from forcefully crashing into and potentially damaging the counterbalance housing 80 as the door 22 is moved to the fully-opened position.

As the door 22 is moved from the fully-opened position back to the closed position, the torsion spring 71 of the counterbalance mechanism 18 is stretched to provide a force which counteracts the weight of the door 22. As such, the torsion spring 71 controls the descent of the door 22 as the door 22 moves toward the closed position. As the door 22 moves toward the closed position, the end roller 37 remains within the outer guide track 40 while the offset rollers 36 remain within the inner guide track 42. As the upper-most offset roller 36 moves through the curved section 54 of the inner track 42, the cable 96 attached to the shaft 38 of that roller 36 is laid over the second pulley 94 and then the first pulley 92 to rest within the grooved section 91 of the respective pulleys 92, 94. Once the cable 96 is laid onto the first pulley 92, the force provided by the cable 96 is redirected from that of a horizontal force to a vertical force. Accordingly, in use, the cable pulleys 92, 94 allow the cable 96 to be redirected as the upper-most offset roller 36 to which the cable 96 is attached goes around the curved section 54 of the inner guide track 40. Thus, as the door 22 is moved to the opened position, the cable 96 begins by pulling in the vertical direction, and then as the upper-most offset roller 36 goes around the curved section 54, the cable operates to pull the door 22 in the horizontal direction. Illustratively, it should be noted that the cable 96 of the cable system 90 is located entirely on the inside of the trailer 10. As such, the cable 96 does not interrupt any seal between the door 22 and the trailer 10 when the door 22 is in the closed, vertical position.

As noted above, the counterbalance housing 80 is positioned approximately ten feet forward of the rear door opening 24 of the trailer 10. The housing 80 is coupled to the roof 20 of the trailer 10 and depends downwardly from the roof 20 approximately three inches. Illustratively, the height of the housing 80 is approximately the same as the height of a header 61 of the trailer 10. The housing 80 extends laterally across a width of the trailer 10 and is generally parallel to the header 61 of the trailer. When the door 22 is in the fully-opened position, the door is generally positioned between the header 61 and the counterbalance housing 80, as shown in FIGS. 3A and 3B. In other words, the horizontal sections 48, 50 of the guide tracks 40, 42 are located between the header 61 and the housing 80 to support the door 22 on the rollers 36, 37 thereon.

Accordingly, because the door 22 is maintained in the space between the header 61 and the housing 80, the upper edge 35 of the door 22 is protected or blocked by the housing 80 in order to prevent this edge 35 of the door 22 from being hit or bumped by freight during an unloading process, for example. In other words, the counterbalance housing 80 operates as a bumper to protect the upper edge 35 of the door 22 when the door 22 is in the opened position. As such, the location of the counterbalance housing 80 allows the door 22 to be located in a protected and out-of-the-way position when the door 22 is in the opened position such that persons, freight, or vehicles, such as forklifts, which are used to carry freight into and out of the trailer 10 do not accidentally bump the upper edge 35 of the door 22, thus potentially causing the door 22 to unintentionally move toward the closed position onto any persons or freight which may be positioned in the rear door opening 24. Furthermore, the housing 80 also operates to protect the torsion shaft 70, the torsion spring 71, and the cable drums 72 located therein from persons, freight, or vehicles which might otherwise accidentally run into the counterbalance mechanism 18 and/or the door 22.

Looking to FIGS. 2A and 3A, a pull-strap assembly 100 is provided to allow an operator to more easily move the door 22 from the horizontal, opened position to the vertical, closed position. As shown in FIGS. 2A and 3A, the pull-strap assembly 100 includes a spool 104 pivotally coupled to the inner surface of the sidewall 16 by a mounting plate 102. The pull-strap assembly 100 further includes a pull-strap 106 having a first end wound around the spool 104 and a second end attached to the axle 38 of the bottom-most roller 36 of the door 22. While the Illustratively, the pull strap 106 includes an elastic portion 108 coupled to the sidewall 16 and a generally non-elastic portion 110 coupled to the door 22. The elastic and non-elastic portions 108, 110 are coupled to each other.

In use, as the door 22 is moved to the horizontal, opened position, the non-elastic portion 110 of the pull-strap 106 is laid across the cable pulleys 92, 94. Illustratively, once the non-elastic portion 110 of the pull-strap 106 engages the cable pulley 92, the elastic portion 108 pull-strap 106 is stretched and thus tensions itself as the door 22 is moved to the horizontal, opened position. As noted above, when the door 22 is in the horizontal, opened position, the door 22 is fully positioned on the horizontal sections 48, 50 of the tracks 40, 42. In other words, generally no portion of the door 22 is position in the curved sections 52, 54 of the tracks 40, 42 such that generally no portion of the door 22 is left to hang downwardly into the rear door opening 24. Thus, in order to move the door 22 from this horizontal, opened position to the vertical, closed position, an operator grabs the portion of the pull-strap 106 positioned below the pulley 92 and pulls downwardly on the pull-strap 106. The pulleys 92, 94 operate to translate this downward force into a horizontal, pulling force on the door 22 in order to move the door 22 horizontally and then vertically toward the closed position.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. An overhead door assembly configured to be coupled to a storage container, such as a truck trailer, comprising:

a guide track system configured to be coupled to one of the sidewalls of the storage container, the guide track system including a first guide track and a second guide track; and a door assembly including a door and plurality of rollers coupled to the door and extending outwardly from a lateral edge of the door, each of the plurality of rollers being received within one of the first and second guide tracks, wherein the plurality of rollers includes an end roller positioned adjacent an upper edge of the door such that a shaft of the end roller is positioned above an upper edge of the door when viewed from the side when the door is in a closed, generally vertical position, wherein a generally vertical plane defined by the outer surface of the door is aligned with or positioned forward of a rearmost portion of the end roller when the door is in the closed, generally vertical position.

2. The overhead door assembly of claim 1, wherein the end roller rotates about an axis aligned with the longitudinal axis of the lateral edge of the door, and further wherein the plurality of rollers further includes a plurality of offset rollers which each rotate about an offset axis spaced-apart from a longitudinal axis of the lateral edge of the door.

3. The overhead door assembly of claim 1, wherein an axis of rotation of the end roller is laterally spaced-apart from the longitudinal axis of the lateral edge of the door.

4. The overhead door assembly of claim 1, wherein the first guide track is positioned generally above the second guide track such that the first guide track is configured to be adjacent to and engaged with one or more roof bows of the storage container.

5. The overhead door assembly of claim 1, further comprising a counterbalance mechanism configured to be positioned at a location spaced-apart from a rear end of the storage container.

6. The overhead door assembly of claim 5, wherein the door is configured to be moved between a vertical, closed position and a horizontal, opened position, and further wherein the counterbalance mechanism is positioned forward of the door when the door is in the horizontal, opened position.

7. The overhead door assembly of claim 5, further comprising a cable system including a first pulley coupled to a vertical section of the first track, a second pulley coupled a horizontal section of the first track, and a cable having one end coupled to the counterbalance mechanism and another end coupled to one of the plurality of rollers.

8. The overhead door assembly of claim 5, further comprising a housing configured to depend downwardly from an inner surface of the roof of the storage container, the counterbalance mechanism being contained within the housing.

9. The overhead door assembly of claim 8, wherein a height of the housing is configured to be approximately the same as a height of a header of the storage container, and wherein the door is configured to be positioned between the header and the housing when the door is in the horizontal, opened position.

10. An overhead door assembly configured to be coupled to a storage container, such as a truck trailer, the overhead door assembly comprising:

a guide track system configured to be coupled to the sidewall of the storage container;

a door assembly including a door and a plurality of rollers coupled to the door and positioned within the guide track system;

a counterbalance mechanism coupled to the guide track system and the door assembly, wherein the counterbalance mechanism is configured to be spaced-apart from a rear end of the storage container;

a housing configured to depend downwardly from an inner surface of the roof of the storage container, the counterbalance mechanism being contained within the housing; and a rebound spring coupled to at least one of the counterbalance mechanism and the housing, wherein the rebound spring extends in a direction rearwardly of the housing, and further wherein a top-most portion of the door engages the rebound spring as the door is moved to the generally horizontal, opened position.

11. The overhead door assembly of claim 10, wherein the door is configured to move between a vertical, closed position and a horizontal, opened position, and further wherein the counterbalance mechanism is positioned forward of the door when the door is in both the closed and opened positions.

12. The overhead door assembly of claim 10, further comprising a cable system including a cable having a first end coupled to the counterbalance mechanism and a second end coupled to a shaft of one of the plurality of rollers.

13. The overhead door assembly of claim 12, wherein the second end of the cable is coupled to an upper half of the door.

14. The overhead door assembly of claim 10, wherein the guide track system includes an upper track configured to be coupled to a sidewall of the storage container and a lower track configured to be coupled to the same sidewall of the storage container, wherein the plurality of rollers includes an end roller adjacent an upper edge of the door and an offset roller adjacent a lateral edge of the door, and further wherein the end roller is received within the upper track and the offset roller is received within the lower track.

15. The overhead door assembly of claim 14, wherein a generally vertical plane defined by the outer surface of the door is aligned with or positioned forward of a rearmost portion of the end roller when the door is in the closed, generally vertical position.

16. An overhead door assembly configured to be coupled to the rear end of a storage container, such as a truck trailer, the overhead door assembly comprising:

a guide track system configured to be coupled to the sidewall of the storage container, the guide track system including a vertical section, a curved section, and a horizontal section;

a door assembly including a door and a plurality of rollers coupled to the door and positioned within the guide track system, the door being movable between a vertical, closed position and a horizontal, opened position;

a counterbalance mechanism coupled to the guide track system and the door assembly; and a cable system including a cable having a first end coupled to the counterbalance mechanism and a second end coupled to one of the plurality of rollers of the door assembly located generally within an upper half of the door, wherein cable system includes a first pulley coupled to the vertical section adjacent the curved section of the guide track and a second pulley coupled to the horizontal section adjacent the curved section of the guide track.

17. The overhead door assembly of claim 16, wherein the cable is engaged with the first and second pulleys when the door is in the closed position and the cable is disengaged from the first and second pulleys when the door is in the opened position.

18. The overhead door assembly of claim 16, wherein the counterbalance mechanism is located forward of the door when the door is in the horizontal, opened position.

19. The overhead door assembly of claim 16, wherein a bottom end of the door is positioned adjacent and engaged with a horizontal section of the guide track system when the door is in the horizontal, opened position.

20. The overhead door assembly of claim 16, further comprising a pull strap assembly having a pull-strap configured to be coupled at a first end to an inner surface of the sidewall of the storage container and coupled at a second end to a bottom-most roller of the plurality of rollers.

21. The overhead door assembly of claim 20, wherein the pull strap includes an elastic portion and a non-elastic portion.

22. The overhead door assembly of claim 20, wherein the pull-strap is engaged with first and second pulleys of the cable system when the door is in the horizontal, opened position and is disengaged from the first and second pulleys when the door is in the vertical, closed position.

23. The overhead door assembly of claim 1, wherein the end roller is rigidly coupled to the door to substantially prevent movement of the shaft of the end roller relative to the door.

24. The overhead door assembly of claim 1, wherein the end roller is located within the first guide track and wherein the first guide track is configured to be adjacent to and engaged with one or more roof bows of the storage container.

25. An overhead door assembly configured to be coupled to a storage container, such as a truck trailer, comprising:

a guide track system configured to be coupled to one of the sidewalls of the storage container, the guide track system including a first guide track and a second guide track, wherein the first guide track includes a first horizontal section positioned generally above a second horizontal section of the second guide track such that the first horizontal section is configured to be adjacent to and engaged with one or more roof bows of the storage container;

a door assembly including a door and a plurality of rollers coupled to the door and extending outwardly from a lateral edge of the door, each of the plurality of rollers being received within one of the first and second guide tracks;

wherein the plurality of rollers includes (i) an end roller positioned adjacent an upper edge of the door such that a shaft of the end roller is positioned above an upper edge of the door when viewed from the side when the door is in a closed, generally vertical position, and (ii) a plurality of offset rollers which each rotate about an offset axis spaced-apart from a longitudinal axis of the lateral edge of the door, wherein a generally vertical plane defined by the outer surface of the door is aligned with or positioned forward of a rearmost portion of the end roller when the door is in the closed, generally vertical position such that an outer surface of the door is prevented from traveling above an upper wall of the first guide track when the door is moved from the closed, generally vertical position to the opened, generally horizontal position, and wherein the end roller is received within the first horizontal section of the first track when the door assembly is in an opened, generally horizontal position, and the plurality of offset rollers are each received within the second horizontal section of the second track when the door assembly is in the opened, generally horizontal position.

* * * * *